United States Patent [19]

Schilling, Jr.

[11] Patent Number: 4,998,042

[45] Date of Patent: Mar. 5, 1991

[54] SELF-RELAMPING CLEARANCE/MARKER LIGHT ASSEMBLY

[76] Inventor: Robert G. Schilling, Jr., R.D. No. 1, Lotville Rd., Box 297-A, Dolgeville, N.Y. 13329

[21] Appl. No.: 366,143

[22] Filed: Jun. 14, 1989

[51] Int. Cl.[5] ..... H05B 39/10

[52] U.S. Cl. ..... 315/93; 315/307; 315/135; 315/77; 340/642

[58] Field of Search ..... 315/93, 65, 88, 90, 315/119, 121, 125, 126, 136; 307/38, 10.8

[56] References Cited

U.S. PATENT DOCUMENTS

| | | | |
|---|---|---|---|
| 1,404,890 | 1/1922 | Patten | 307/38 |
| 1,869,091 | 7/1932 | Brander | 315/125 |
| 1,938,828 | 12/1933 | Gordon | 315/83 |
| 1,972,514 | 9/1934 | Engelhard | 315/93 |
| 1,983,308 | 12/1934 | Ricker | 315/93 |
| 4,380,718 | 4/1983 | Miller | 315/93 |
| 4,712,051 | 12/1987 | Fathi | 315/88 |

*Primary Examiner*—Eugene R. LaRoche
*Assistant Examiner*—Son Dinh
*Attorney, Agent, or Firm*—Marshall & Mellhorn

[57] ABSTRACT

A self-relamping clearance/marker light assembly includes a pair of lamps connected to a proving ring switch. A primary one of the almps is lighted and the switch prevents current flow through a secondary one of the lamps until the primary lamp burns out. The lamps are operated at a derated voltage to increase life and a small compensating lamp provides the necessary additional illumination lost through the reduced voltage operation of the primary and secondary lamps. The lamps are mounted for isolation from high frequency vibration and shock impacts using the lamp lead wires to form part of the shock mounting.

20 Claims, 2 Drawing Sheets

SELF-RELAMPING CLEARANCE/MARKER LIGHT ASSEMBLY

BACKGROUND OF THE INVENTION

The present invention relates generally to incandescent lighting fixtures and, in particular, to vehicle clearance and marker light assemblies for self-relamping upon the failure of such lights.

Commercial truck and trailer lighting systems are a relatively high expense maintenance item. Various laws dictate the placement and lighting characteristics of an array of marker lights and clearance lights which are required for such commercial vehicles to travel on public roads. Harsh operating conditions cause frequent failures which can be costly in terms of fines and schedule interruptions. Thus, frequent maintenance is required and is complicated and made more expensive by the large number of such lights and their relative inaccessibility.

A lamp is most prone to failure under the combined stresses of age and vibration. Therefore, a lamp will, in all probability, fail while the vehicle is in active service. Since many of the lamp assemblies must be located as much as twelve feet above the ground, the probability of a vehicle operating with one or more burned out lamps is quite high. One attempt to overcome this problem has resulted in a twin lamp assembly wherein when one lamp has burned out, the other lamp still provides a legal level of illumination.

Twin lamp fixtures typically have shock absorbent sockets for the lamps in an attempt to isolate the lamps from the various vibrations and shocks generated during operation of the vehicle. A commonly utilized lamp is a #194 which has an average "laboratory" lighting life of 1,500 hours. However, under the rigors of actual field service this life is, in reality, closer to 800 operating hours. Thus, a line-haul vehicle running for approximately eight hours per night, would require a complete clearance/marker light relamping every five months. Furthermore, since most commercial fleets relamp on an "as spent" basis, constant service attention is required to maintain a legal status and such operation is very costly. Even a minimally equipped semitrailer requires eleven light fixtures of this type, making it necessary to replace twenty-two lamps having a random failure pattern. Thus, it can be easily seen that by extending the average bulb life by a factor such as ten, the mandatory relamping cost can be reduced dramatically.

It is therefore, an object of the present invention to provide a clearance/marker light assembly which can extend the total relamping of a commercial vehicle to approximately four years.

It is another object of the present invention to provide a clearance/marker light assembly which significantly reduces the magnitude of the vibrations and shocks transmitted from the vehicle to the lamps in the assembly.

It is another object of the present invention to provide a clearance/marker light assembly which reduces the current draw by approximately one third over prior art light assemblies.

SUMMARY OF THE INVENTION

The present invention concerns an apparatus for automatically relamping a clearance/marker light assembly for use on a vehicle. A primary lamp is connected in series with the coil of a "proving ring" switch between a pair of power leads. The proving ring switch has a pair of normally closed contacts and a secondary lamp is connected between one of the contacts and one of the power leads. The other one of the contacts is connected to the other one of the power leads and the coil. Electrical current normally flows through the coil and the primary lamp to actuate the switch and disconnect the secondary lamp from the power source. When the primary lamp burns out, the switch returns to the normally closed contact position and current flows through the secondary lamp to provide an automatic or self-relamping feature. The geometry of the switch makes it relatively insensitive to shock and vibration that might cause "flicker" of the light.

The life of the primary and secondary lamps is also increased by a significant amount by operating the lamps on reduced voltage. A pair of diodes are connected in series between the power source and the switch coil to reduce the voltage applied to the primary lamp by two diode forward voltage drops as well as the voltage drop across the switch coil. When the primary lamp burns out, a diode connected between the switch and the secondary lamp provides an incremental voltage drop similar to that of the switch coil. Since a certain amount of illumination is lost through the derated voltage operation, a small compensating lamp or high brightness L.E.D. assembly having a minimum rated life of 10,000 hours is connected across the electrical leads to provide the additional illumination required to comply with Federal Motor Vehicle Standards.

Typically, the light assemblies are mounted on a generally vertically extending surface of a vehicle. In order to isolate the filaments of the lamps from vibration and shocks, the lamps are mounted with a mechanically lossy material and/or clip to a washer which in turn is attached to a base through a thicker cross section of the same material. The washer is formed of a heavy metal material, such as lead, to provide a means of lowering the natural frequency of oscillation of the lamp in order to desensitize it to horizontally propagated road vibrations. Construction in the vertical plane has the characteristic of high loss for dampened vertical bulb excursions under impact conditions. In addition, the power lead can have a reduced cross-sectional area which serves as an in-line fuse or contain an inserted fuse to protect the vehicle electrical system from a short circuit should the light assembly be severely crushed against the body of the vehicle. This fuse element is located at or below the mounting surface of the vehicle to shield it.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
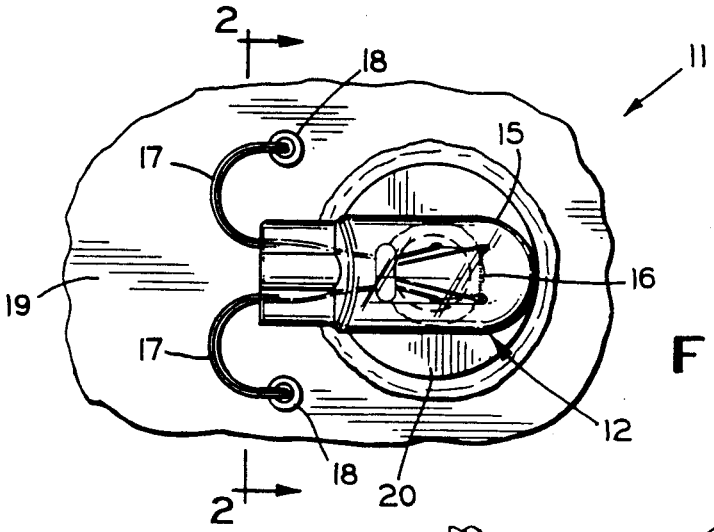
FIG. 1 is a fragmentary plan view of one lamp mounted in a light assembly in accordance with the present invention.
Figure 2:
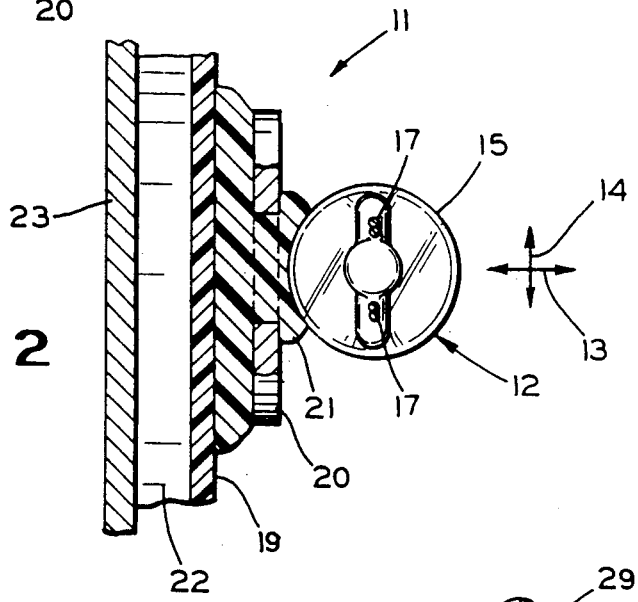
FIG. 2 is a cross-sectional view taken along the line 2—2 in FIG. 1.

There is shown in FIGS. 1 and 2 a portion of a self-relamping clearance/marker light assembly 11 in accordance with the present invention. Shock and vibration are major elements in shortening the life of any lamp. Shorter filament designs have a higher resistance to shock, but the common lamps used in twelve volt clearance/marker lights, such as #193 and #194 lamps, are not of this type of design. The light assembly 11 can be utilized to replace any of the prior art standard type clearance/marker light assemblies. However, the above-identified commonly utilized lamp types are preferably utilized in the present invention from a cost and lamp replacement standpoint. The characteristics of these lamps are well known and the light base and cover can be of conventional design or a permanently sealed design.

The light assembly 11 includes a lamp 12 mounted in a manner that minimizes the effects of both road shock and vibration. In conventional light assemblies, it has been common to mount the lamps with a mechanically lossy elastomeric material such as a silicone. The silicone has some damping effect, but does not specifically address the two types of shocks which occur. If the assembly 11 is mounted on a side wall of a vehicle such as a semitrailer as shown in the drawings, a high frequency vibration is more likely to occur in a horizontal plane as represented by an arrow 13 in FIG. 2. The vibrations in the vehicle wall can be generated by any one or more of a number of sources such as the vehicle engine, and natural oscillations of various parts of the vehicle body. High displacement impact type shocks occur mostly in a vertical plane as represented by an arrow 14 and are caused generally by road hazards such as pot holes.

The lamp 12 has a wedge mount glass envelope 15. The envelope 15 is mounted such that a filament 16 inside the envelope extends in a plane generally parallel to the vertical plane 14. Such orientation increases the resistance of the filament 16 to the impact type shocks the light assembly will be subjected to during operation. A pair of lamp leads 17 are folded outward from the wedge base and extend from the base of the envelope 15 and are attached, typically by soldering, to a pair of eyelet type terminals 18 mounted on a base 19 of the light assembly. The lamp leads 17 are formed into circular arcs to provide springlike resilience in the in the vertical plane 14, no matter how the lamp housing is oriented when mounted.

The envelope 15 is attached to a generally planar mass such as a washer 20 by a relatively thin layer of mechanically lossy adhesive material 21. The washer 20, in turn, is attached to an outwardly facing surface of the base 19 by a relatively thicker section of the same adhesive material 21. The filaments 16, the base 19, and the washer 20 each extend in generally parallel planes. The washer 20 is formed of a heavier metal material, such as lead, to provide a means of lowering the natural frequency of oscillation of the lamp 12. The lamp leads 17 are curved in an arc and firmly attached to the eyelets 18 within the vertical plane to further aid in reducing the stiffness in the horizontal plane 13. The surface of the washer 20 facing the lamp 12 can be made reflective to provide additional light gain. The adhesive material 21 is a highly damped low durometer elastomeric material such as a silicone and extends through the center of the washer 20 to the base 19 to provide a continuous connection between the envelope 15 and the base 19. In this configuration, the mounting has the characteristics of high loss and low natural frequency for absorbing most of the high frequency vibrations in the horizontal plane 13. The mounting has the characteristic of higher stiffness for controlled deflection under impact conditions in the vertical plane 14 even with the additional mass of the washer 20.

The base 19 can be directly mounted on the outer surface of a vehicle wall. As discussed below, the lamp leads 17 are connected to electrical conductors attached to the power system of the vehicle. Typically, an aperture must be provided in the vehicle wall to make a connection between the electrical system and the light assembly 11. Therefore, the light assembly 11 can be provided with insulated power leads which may require some degree of clearance between the vehicle wall and the base 19. As shown in FIG. 2, the base 19 can be formed with an inwardly extending peripheral flange 22 to space the base 19 from a wall 23 of a vehicle. Any conventional form of mounting can be utilized for the light assembly 11. One of the most common forms of mounting is to provide a base with internal holes or flanges having apertures for receiving threaded fasteners.

Figure 3:
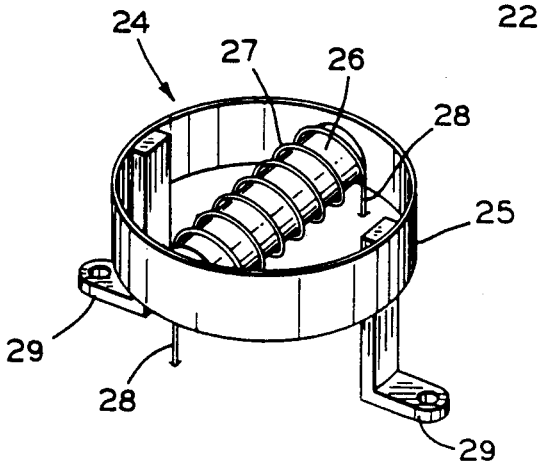
FIG. 3 is a perspective view of a proving ring switch in accordance with the present invention.

In order to extend the life of the light assembly 11 and to render it self-relamping, a pair of the lamps 12 are provided on the base 19. One of these lamps is operated until it fails and then the vehicle power is transferred to the other one of the lamps for continued service. The power is transferred by a proving ring switch 24 shown in FIGS. 3 and 4. The switch 24 is inexpensive in construction and has high reliability and immunity from vibration. As an alternative, a form-A glass reed relay utilizing two magnetically opposed driver coils will function satisfactorily. A thin springlike circular band 25 of magnetic metal extends about a magnetizable cylindrical core 26. The band 25 can be formed of steel and the core formed of soft iron, for example. An electromagnetic coil 27 is formed from a wire wrapped about the cylindrical iron core 26. The opposite ends of the coil 27 form a pair of leads 28 which will be discussed below. The band 25 can be formed of any suitable material and can be plated for corrosion resistance and improved electrical contact.

Figure 4:
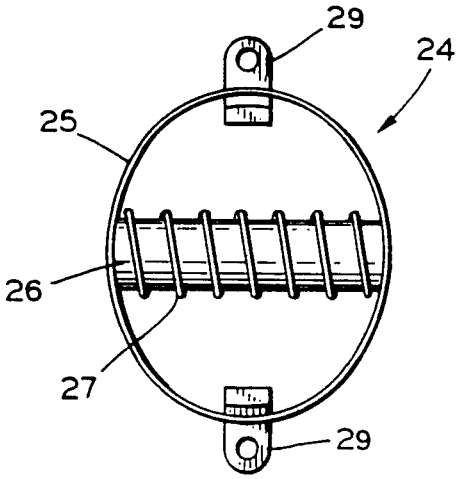
FIG. 4 is a plan view of the switch shown in FIG. 3.

The band 25 is sized so that it does not touch the ends of the iron core 26. However, a pair of diametrically opposed contacts 29 extend into and abut the inner wall of the band 25 to form a normally closed switch. The band 25 is sized so as to exert a firm pressure on both contacts 29 over the temperature range that the light assembly might be exposed to in the absence of any magnetic force. Due to the geometric properties of the thin circular ring, the ring will elongate when current flows through the coil 27 to generate magnetic force to pull the ring to the ends of the iron core 26 as shown in FIG. 4. Under this condition, the ring will elongate along a diameter perpendicular to the longitudinal axis of the core 26 thereby breaking the electrical connection with the contacts 29 which are located along such diameter and opening the switch. Depending upon the dimensional tolerances and other factors, the ring 25 may break electrical contact with only one or both of the contacts 29. It will be impossible for the band to be so distorted and not break electrical contact with at least one of the contacts 29. Therefore, even if vibration would cause the band to shift and again abut one of the contacts 29, the band would necessarily be spaced from the other one of the contacts 29.

Figure 5:
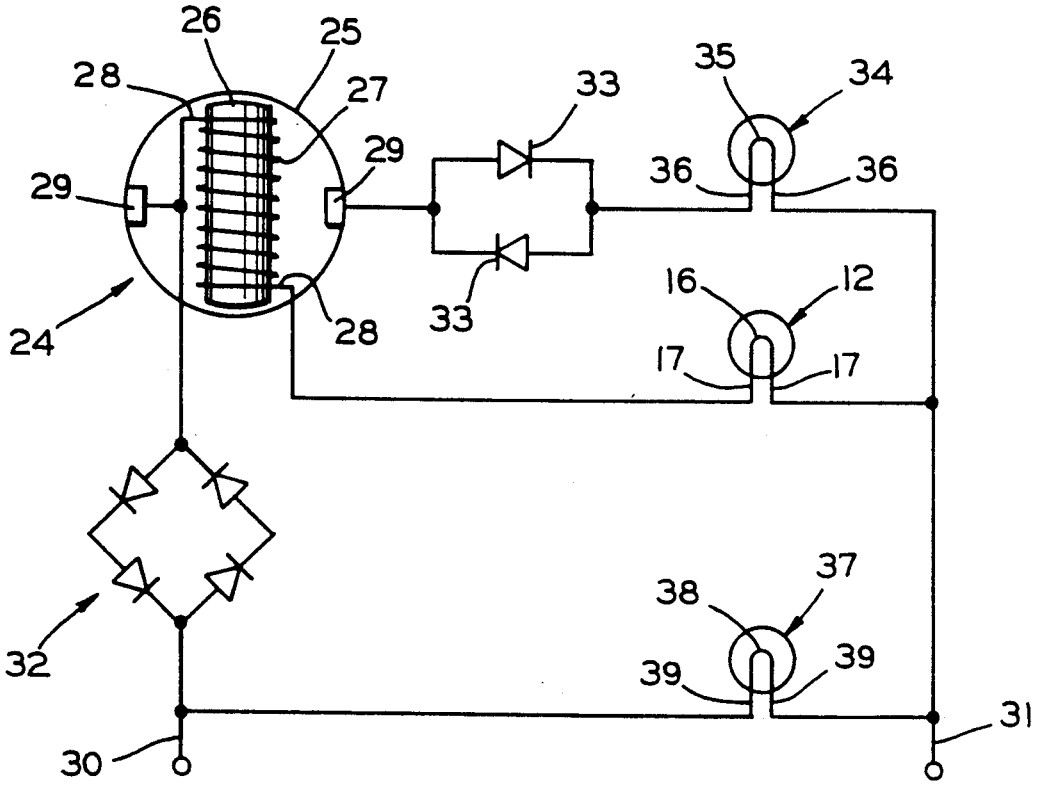
FIG. 5 is an electrical schematic of a light assembly in accordance with the present invention.

There is shown in FIG. 5 an electrical schematic of the light assembly according to the present invention. A pair of electrical leads 30 and 31 are adapted to be connected to the vehicle power supply. The leads 30 and 31 can be connected with either polarity. The electrical lead 30 is connected through a diode bridge 32 to one of the leads 28 of the coil 27. The other one of the leads 28 is connected to one of the leads 17 of the primary lamp 12. The other one of the leads 17 is connected to the electrical lead 31. When direct current power from the vehicle power source is connected to the electrical leads 30 and 31, current flows through the bridge 32, through the coil 27 and through the filament 16 of the lamp 12 to the electrical lead 31. The two diodes connected in series through which the current is flowing in the diode bridge 32 and the coil 27 each provide a fixed voltage drop of approximately 0.63 volts. The four diode bridge provides bidirectionality for use on either positive or negative ground vehicle systems.

The energized coil 27 creates a magnetic field which attracts the band 25 to the core 26 thereby breaking contact with one or both of the contacts 29. One of the contacts 29 is connected to the lead 28 which is connected to the diode bridge 32. The other one of the contacts 29 is connected to the lead 31 through a pair of opposed parallel connected diodes 33 and a lamp 34 in series. The lamp 34 has a filament 35 connected to a pair of lamp leads 36. The circuit is completed by a small compensator lamp 37 having a filament 38 and lamp leads 39 connected between the electrical leads 30 and 31.

The coil drop equalizer diodes 33 provide a voltage drop approximately the same as the coil 27 so that the same voltage is applied to each of the lamps 12 and 34. The nominal voltage on vehicle equipment under power is assumed to be 13.8 volts direct current. Both of the lamps 12 and 34 should operate at about eighty-five percent of nominal or about twelve volts. Each of the diodes in the bridge 32, the coil drop equalizer diodes 33 and the coil 27 provide a fixed forward voltage drop of approximately 0.63 volts. Three such voltage drops in series provide a voltage reduction of 1.9 volts to reduce the nominal voltage of 13.8 to 11.9 volts. 11.9 volts is eighty-five percent of the rated design voltage of the lamps. The reduced voltage operation extends the life of each lamp by approximately seven hundred percent. If the average life of the lamp at the rated voltage is eight hundred hours, the average life of the lamp running at the reduced voltage is approximately 5,600 operating hours. The penalty to be paid for increasing the life through voltage derating is a loss of illumination output. To comply with Federal Motor Vehicle Standards, the compensator lamp 37 must be utilized. A #37 miniwedge type or similar short filament lamp having a 10,000 hour life and providing approximately 0.5 MSCP is used to compensate for the loss of light from the primary lamp 12 and the secondary lamp 34.

The graphs of typical lamp characteristics show a drop from 2.0 MSCP to 1.4 MSCP output for the model #194 lamp operating at eighty-five percent of rated voltage. However, 0.1 MSCP of the drop is taken up in the "Red Shift" that biases the spectral output of the lamp toward the red/yellow end of the spectrum. The reduction in energy at this end of the spectrum is less than the reduction calculated for the summation of all wave lengths. That is, the energy output at the blue end of the spectrum collapses faster than at the red end of the spectrum. The resulting output of the two lamps in concert, the primary lamp 12 (or lamp 34) and the compensator lamp 37 achieve a red or amber illumination level equivalent to a #194 lamp burning at 13.8 volts.

The derated primary lamp 12 will draw approximately 0.25 amperes of current. The compensator lamp 37 typically draws 0.1 amperes such that the combined total of 0.35 amperes of current compares favorably with prior light assemblies. A prior art assembly with two #194 type lamps burning at 0.27 amperes each or two long-life #193 type lamps at 0.33 amperes each draws more current than the present invention which provides a minimum current draw savings of thirty-five percent. If the current draw of 0.35 amperes for the present invention is compared with the prior art #194 type assembly drawing 0.54 amperes total, the savings of 0.19 amperes times eleven assemblies (the minimum number of lamp assemblies mandated by Federal Law), results in a savings of two amperes. Obviously, the use of additional light assemblies in accordance with the present invention will result in even more power savings.

When the primary lamp 12 fails, current flow will cease through the coil 27. The springlike circular band 25 will return to the configuration shown in FIG. 5 thereby contacting both of the contacts 29. Current will now flow through the secondary lamp 34 thereby providing a self-relamping function at the same illumination level as was provided by the primary lamp 12. Thus, the light assembly according to the present invention should operate satisfactorily for 10,000 hours of on-time. Therefore, the principal source of premature failure would be a physical impact applied to the lens or the case of the light assembly. Although the lens (not shown) and the base 19 would typically be formed of some electrically insulating and durable material, such as polycarbonate, the possibility still exists that the surface mounted light assembly may be crushed or wiped from the vehicle body by contact with another object such as a door frame or wall. If the case is damaged, there exists the possibility that the components of the electrical circuit shown in FIG. 5 could come into contact with metal portions of the vehicle's body thereby shorting the vehicle's electrical system. In order to protect against such a failure, an in-line fuse assembly can be provided.

Figure 6:
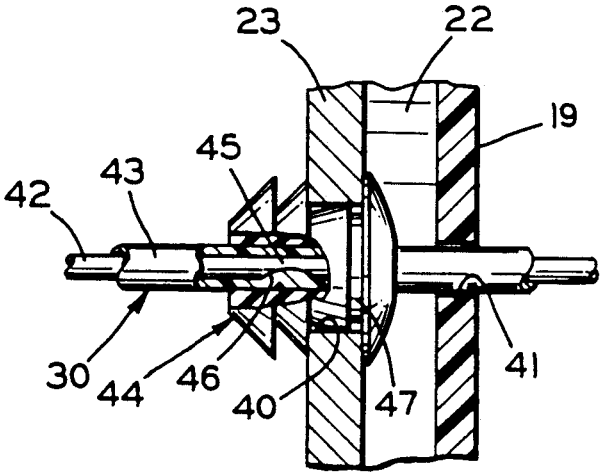
FIG. 6 is a cross-sectional view of a fusible electrical connector in accordance with the present invention.

Referring to FIG. 6, there is shown the light assembly base 19, flange 22 and vehicle wall 23. An aperture 40 is formed in the vehicle wall 23 and an adjacent aperture 41 is formed in the base 19. The electrical lead 30 extends from the electrical circuit in the interior of the light assembly through the aperture 41 and through the aperture 40 to a connection (not shown) with the vehicle power supply. The lead 30 consists of a wire core 42, either solid or stranded, covered by an insulating material 43. A grommet 44 can be molded on the lead 30 to protect both the insulation material 43 and an in-line fuse 45 from the edges of the aperture 40. The fuse 45 can be created by forming a reduced cross-sectional area with a notch 46 in the wire core 42 or by the insertion of a small fusing device. The grommet 44 positions the fuse 45 at or inside the surface of the vehicle wall 23 at all times. Therefore, any damage to the light assembly which would cause a short circuit will not affect the functioning of the fuse 45 to protect the vehicle power system. The grommet 44 is configured to cooperate with a relatively thick wall 23 as shown in FIG. 6. In addition, the grommet 44 has a narrow annular groove 47 formed therein for cooperating with an aperture formed in a relatively thinner vehicle wall.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A self-relamping clearance/marker light apparatus, comprising:

a pair of electrical leads each adapted to be connected at one end to an electrical power source and each having an opposite end;

a primary lamp;

a switch having a coil and a pair of normally closed contacts, said coil being connected in series with said primary lamp between said opposite ends of said electrical leads;

a secondary lamp connected between one of said switch contacts and one of said opposite ends of said electrical leads, the other one of said opposite ends being connected to the other one of said switch contacts whereby when said electrical leads are connected to an electrical power source, electrical current flows through said coil and said primary lamp and said switch is actuated to open said contacts to prevent current from flowing through said secondary lamp, and whereby when said primary lamp burns out, current flow through said coil stops and said switch closes said contacts to allow current to flow through said secondary lamp;

a generally planar base;

a generally planar mass having on aperture formed therein and positioned between said primary lamp and said base; and a mechanically lossy material extending through said aperture and attaching said primary lamp to said mass and attaching said mass to said base.

2. The apparatus according to claim 1 wherein at least one of said electrical leads has an in-line fuse therein.

3. The apparatus according to claim 2 wherein said in-line fuse is formed by a reduced cross-sectional area in a core of said one electrical lead.

4. The apparatus according to claim 1 wherein said base is adapted to be attached to a surface of a vehicle, and including means for mounting said secondary lamp on said base wherein each of said primary lamp and said secondary lamp includes a filament which extends in a plane generally parallel to a plane of said base.

5. The apparatus according to claim 4 wherein said primary lamp and said secondary lamp each include a glass envelope surrounding the associated one of said filaments and wherein said mounting means includes a planar mass and mechanically lossy material, said mechanically lossy materials attaching said glass envelopes to said planar masses and said planar masses to said base.

6. The apparatus according to claim 5 wherein a surface of each said mass facing an associated said filament is light reflective.

7. The apparatus according to claim 1 wherein said switch includes a circular band formed of a magnetic, electrically conductive material abutting said pair of contacts and a magnetizable core extending through said coil whereby when electrical current flows through said coil, said band is magnetically attracted to said core thereby deforming and breaking contact with at least one of said contacts.

8. The apparatus according to claim 1 including means for generating a voltage drop connected in series with said primary lamp and said secondary lamp.

9. The apparatus according to claim 8 including a compensator lamp connected between said electrical leads.

10. A self-relamping lighting apparatus, comprising:

a generally planar base;

a primary lamp;

a generally planar mass positioned between said primary lamp and said base;

a mechanically lossy adhesive material attaching said primary lamp to said mass and said mass to said base;

a secondary lamp attached to said base;

a switch mounted on said base and having a pair of normally closed contacts and means for actuating said switch; and a pair of electrical leads each adapted to be connected at one end to an electrical power source and each having an opposite end, said switch contacts and said secondary lamp being connected in series between said opposite ends of said electrical leads, and said primary lamp being connected in series with said means for actuating said switch between said opposite ends of said electrical leads whereby when said electrical leads are connected to a source of power, said means for actuating opens said contacts and current flows through said primary lamp, and when said primary lamp burns out, said means for actuating closes said switch contacts and current flows through said secondary lamp.

11. The apparatus according to claim 10 including another generally planar mass positioned between said secondary lamp and said base and wherein said secondary lamp is attached to said second mass and said second mass is attached to said base by a mechanically lossy adhesive material.

12. The apparatus according to claim 10 wherein said generally planar mass is a washer having an aperture formed therein and said mechanically lossy adhesive material extends between said primary lamp and said base through said aperture.

13. The apparatus according to claim 10 wherein said switch is a proving ring switch and said means for actuating is a coil connected between one of said electrical leads and said primary lamp.

14. The apparatus according to claim 10 wherein at least one of said electrical leads has an in-line fuse formed therein as a reduced cross-sectional area of a current carrying conductor.

15. The apparatus according to claim 10 including means for generating a voltage drop connected in series with said primary lamp and said secondary lamp and a compensator lamp connected between said electrical leads.

16. A self-relamping clearance/marker light assembly, comprising:

a pair of electrical leads each adapted to be connected at one end to an electrical power source and each having an opposite end;

a generally planar base;

a primary lamp and a secondary lamp;

a pair of generally planar masses each positioned between one of said lamps and said base;

a mechanically lossy material attaching each of said lamps to an associated one of said masses and attaching said masses to said base;

a switch having a pair of normally closed contacts and means for opening said contacts, said contacts being connected in series with said secondary lamp between said electrical leads and said means for opening connected in series with said primary lamp between said leads; and a compensator lamp connected between said leads whereby when said leads are attached to a electrical power source, said primary lamp and said compensator lamp are lighted and when said primary lamp burns out, said means for opening said contacts is disabled and said secondary lamp and said compensator lamp are lighted.

17. The light assembly according to claim 16 including an in-line fuse formed as a reduced cross-sectional area in a core wire of at least one of said leads.

18. The light assembly according to claim 16 including a full wave diode bridge connected between one of said leads and said switch for generating a voltage drop and providing bipolar operation.

19. The light assembly according to claim 16 including a pair of diodes connected in parallel back-to-back relationship between said switch and said secondary lamp.

20. The light assembly according to claim 16 wherein each of said primary and secondary lamps has a pair of lamp leads extending in circular arcs from a lamp envelope and attached to said base at spaced apart terminals mounted on said base for shock absorption.

* * * * *